US007841416B2

(12) United States Patent
Henschel et al.

(10) Patent No.: US 7,841,416 B2
(45) Date of Patent: Nov. 30, 2010

(54) METHOD AND APPARATUS FOR RETAINING A SOFT SEAL IN AN INTEGRATED FLAPPER MOUNT, HARD SEAT, SPRING HOUSING SURFACE CONTROLLED SUBSURFACE SAFETY VALVE

(75) Inventors: Robert C. Henschel, The Woodlands, TX (US); Win Sides, Bellaire, TX (US); Jason C. Mailand, The Woodlands, TX (US); Adrian V. Saran, Kingwood, TX (US); Mario Robles, Cypress, TX (US)

(73) Assignee: BJ Services Company LLC, Houston, TX (US)

( * ) Notice: Subject to any disclaimer, the term of this patent is extended or adjusted under 35 U.S.C. 154(b) by 260 days.

(21) Appl. No.: 11/894,356

(22) Filed: Aug. 21, 2007

(65) Prior Publication Data

US 2008/0047713 A1 Feb. 28, 2008

Related U.S. Application Data

(60) Provisional application No. 60/839,365, filed on Aug. 22, 2006.

(51) Int. Cl.
*E21B 34/14* (2006.01)

(52) U.S. Cl. ..... 166/386

(58) Field of Classification Search ..... 166/332.8, 166/334.1, 332.1, 386; 277/314
See application file for complete search history.

(56) References Cited

U.S. PATENT DOCUMENTS 3,375,874 A 4/1968 Cherry et al. ..... 166/114
4,356,867 A 11/1982 Carmody ..... 166/373
4,444,266 A * 4/1984 Pringle ..... 166/324
4,674,575 A * 6/1987 Guess ..... 166/332.8

(Continued)

FOREIGN PATENT DOCUMENTS

GB 2248464 A 4/1992

(Continued)

OTHER PUBLICATIONS

European Search Report, Oct. 26, 2007, 2 Pages.

*Primary Examiner*—William P Neuder
(74) *Attorney, Agent, or Firm*—Zarian Midgley & Johnson PLLC

(57) ABSTRACT

Presented is a subsurface safety valve in which the flapper mount, hard seat and spring housing have been integrated into a single assembly. To accommodate a "soft seat insert," a special retainer soft seat ring and soft seat seal are provided. The soft seat seal fits over a conical protruding surface (hard seat) that surrounds the main bore of the safety valve on the bottom side of the spring housing. The retainer ring fits over the soft seat seal and holds it in place against the conical surface. Notches along the perimeter of an upper flanged end of the soft seat seal prevent gases, such as nitrogen, from becoming trapped behind the seal and potentially damaging it during a rapid decompression event. A gap between the upper flanged end of the soft seat seal and the lower spring housing allow the seal to move up and down the conical protruding surface as the flapper opens and closes, reducing compression of the seal and the risk of a compression set due to repeated opening and closing of the flapper.

21 Claims, 4 Drawing Sheets

U.S. PATENT DOCUMENTS 5,125,457 A * 6/1992 Meaders ..... 166/322
5,201,371 A * 4/1993 Allen ..... 166/325
6,003,605 A 12/1999 Dickson et al. ..... 166/375
6,079,497 A * 6/2000 Johnston et al. ..... 166/324
6,296,061 B1 * 10/2001 Leismer ..... 166/386
6,328,109 B1 12/2001 Pringle et al. ..... 166/373
6,425,413 B2 * 7/2002 Davis et al. ..... 137/527
7,152,688 B2 * 12/2006 Richards ..... 166/386
7,360,600 B2 * 4/2008 MacDougall et al. .... 166/332.8

FOREIGN PATENT DOCUMENTS

GB 2272922 A 6/1994

* cited by examiner

METHOD AND APPARATUS FOR RETAINING A SOFT SEAL IN AN INTEGRATED FLAPPER MOUNT, HARD SEAT, SPRING HOUSING SURFACE CONTROLLED SUBSURFACE SAFETY VALVE

CROSS REFERENCE TO RELATED APPLICATIONS

This application claims priority from U.S. Provisional Patent Application Ser. No. 60/839,365, filed on Aug. 22, 2006, which is hereby incorporated by reference in its entirety.

FIELD OF THE INVENTION

This invention relates to the field of subsurface safety valves and, more particularly, to a subsurface safety valve having a spring housing with an integrated flapper mount and hard seat in which a soft seat sealing component is installed and retained by a retaining ring into the spring housing.

BACKGROUND OF THE INVENTION

Subsurface safety valves are well known in the art. They are used in a well, such as an oil or gas well, to provide a safety shut off in the event of a well failure. A subsurface safety valve is typically installed in a production tubing string and run downhole into the well. The valve is typically a normally-closed valve, in that the valve automatically shuts under default conditions, such as when the hydraulic control fluid to the valve is interrupted. When shut, the safety valve does not allow contents from below the safety valve, such as production fluids, to continue flowing to the surface of the well. Uncontrolled flowing production fluid, such as gas or other hydrocarbons, may cause explosions or otherwise damage surface facilities and/or cause environmental damage in the event of a well failure.

Referring to FIG. 1, typically, a valve element, such as a disk-shaped flapper 10, is used to seal off the production fluid in a main bore 50 of the safety valve. The flapper 10 is attached to a hinged valve element known as a flapper mount, and can be pivoted to an open position to allow production fluid to flow. The flapper 10 is typically forced open by a flow tube 5 mounted in a bore 50 of the subsurface safety valve. The flow tube 5 slidably engages the flapper 10 overcoming the torsion spring force maintaining the flapper closed. The flow tube 5 moves longitudinally down the bore 50 and pushes the flapper 10 out of the main bore flow path. In many designs, an actuator 15 having a piston in a side chamber adjacent to the main bore 50 is remotely actuated to cause the flow tube 5 to move down to engage the flapper 10 and force the flapper 10 out of the flow path. A power spring 25 inside the spring housing 30 is compressed between the flow tube 5 and a shoulder within the spring housing 30 to force the flow tube 5 up to allow the flapper 10 to enter and close off the main bore 50.

A subsurface safety valve with a spring housing containing a flapper mount, hard seat and a sealing component is typically manufactured in several pieces. The spring housing usually forms one piece, and it contains the flow tube with an upwardly biasing spring, and an adjacent piston. The flapper mount, which includes the flapper and hinge, and a sealing component, generally form one or more other pieces. The flapper mount attaches to the lower end of the spring housing through a variety of connection methods, usually a threaded connection, which screw together. The sealing component is usually trapped between the hard seat and the flapper mount. When the flapper is closed, the outer perimeter of the flapper presses against an annular opening of the main bore of the safety valve to seal the well. The contact area between the flapper and the main bore of the safety valve usually comprises both a "hard seat," which is a metal-to-metal contact between the flapper and the bore, and a "soft seat," which is a metal-to-non-metal contact between the flapper and the sealing component.

Safety valves thus comprised have several leakage paths. One path is through the hard seat/soft seat interface when the flapper is closed. Another leakage path is through the connection between the flapper mount and the spring housing. A third leakage path is through the connection between the hard seat and spring housing or flapper mount.

When the components of the safety valve assembly (the flapper mount, hard seat and spring housing) are individual components, the tolerance of the connections between the components interacts with the design tolerances of the flapper, making the overall flapper design less reliable and its manufacture more difficult. One way to eliminate the leakage paths through these connections and the interaction (or stack up) of the tolerances between the flapper mount, hard seat and the spring housing is to integrate the flapper mount, hard seat and spring housing designs creating one piece. Removing the connection between the flapper mount, hard seat and the spring housing increases the reliability of the seal by removing multiple leak paths and eliminates the interaction of tolerances between the individual components and the flapper design.

SUMMARY OF THE INVENTION

The apparatus of the present invention integrates the flapper mount, the hard seat and the spring housing into a single assembly. To accommodate a "soft seat" in the assembly, a special retainer ring and soft seat seal are provided. The soft seat seal preferably fits over a conical protruding surface that surrounds the main bore of the safety valve at the bottom of the spring housing (hard seat). The retainer ring preferably fits over the soft seat seal and holds it into place against the conical surface. According to one embodiment, the retainer ring has tabs that fit into mating slots on the bottom of the spring housing. During assembly, the tabs rotate into grooves adjacent to the mating slots to hold the soft seat seal into place. The soft seat seal may have a flanged upper end that fits into a circular, milled slot at the base of the hard seat on the spring housing. Notches along the perimeter of the flanged upper end of the seal prevent gases, such as nitrogen during testing, from becoming trapped behind the seal and potentially damaging it when the pressure below a closed flapper is rapidly bled, resulting in trapped gases rushing out from behind the seal and deforming it. A gap between the upper flanged end of the seal and the bottom side of the spring housing allows for thermal expansion of the seal at elevated temperatures as well as allowing the seal to move up and down the conical protruding surface as the flapper opens and closes, reducing compression of the seal and the risk of a compression set due to repeated openings and closings of the flapper.

The apparatus of the present invention further includes a method of sealing the central bore of production tubing against fluid flowing from a wellbore towards the surface. The disclosed method comprises the step of attaching a safety valve assembly to the production tubing, the safety valve assembly comprising a spring housing having a lower portion that exhibits a generally conical shape, a non-metallic sealing ring concentrically located around the generally conically-shaped portion of the spring housing, a retainer ring adapted to retain the non-metallic sealing ring around the generally conically-shaped portion of the spring housing, and a flapper connected to the lower portion of the spring housing, the flapper operable to rotate between an open and closed position. The disclosed method further comprises the step of placing the safety valve assembly and the production tubing in a wellbore. Finally, the disclosed method comprises the step of closing the flapper such that the flapper seals against the generally conically-shaped portion of the spring housing and the non-metallic sealing ring thereby substantially preventing fluid from flowing from the wellbore towards the surface through the central bore of the production tubing.

DETAILED DESCRIPTION

Figure 1:
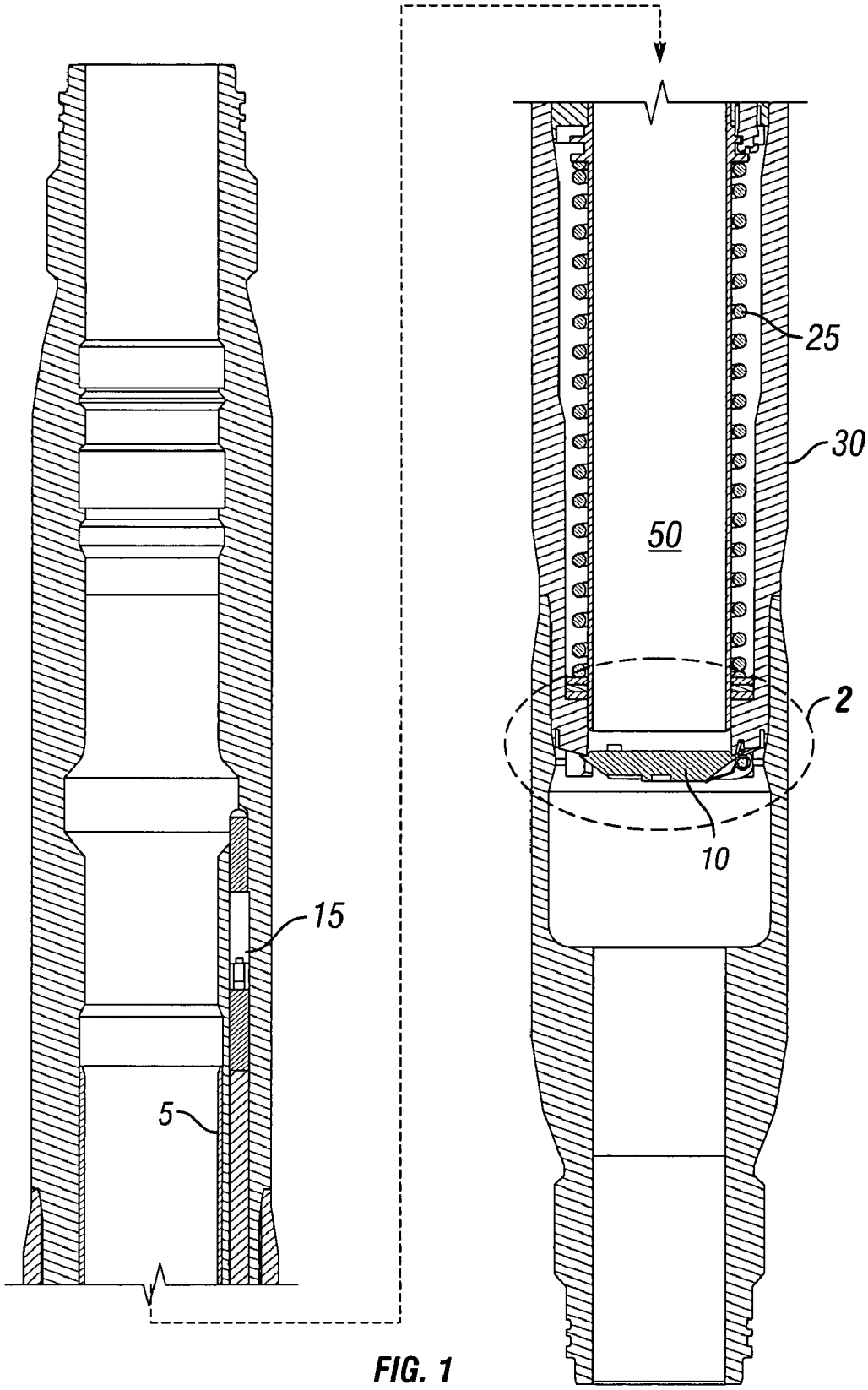
FIG. 1 is a cross-sectional view of an exemplary embodiment of a typical subsurface safety valve with integrated flapper mount, hard seat and soft seat seal with tabbed soft seal retaining ring.
Figure 2:
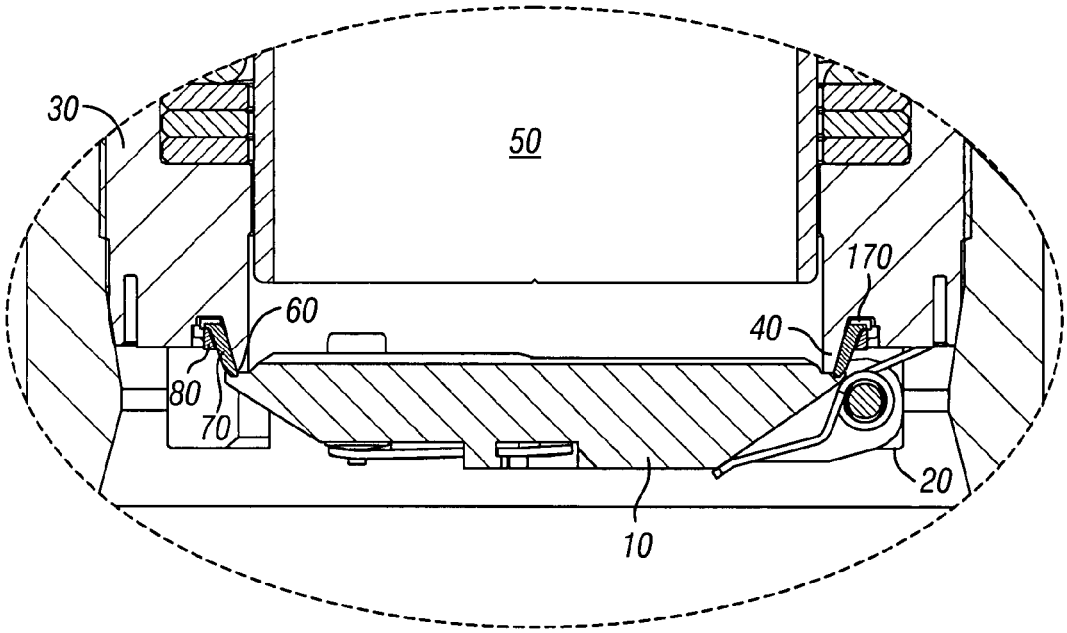
FIG. 2 is a sectional view of an exemplary embodiment of a typical subsurface safety valve with integrated flapper mount, hard seat, and soft seat seal with tabbed retaining ring.
Figure 3:
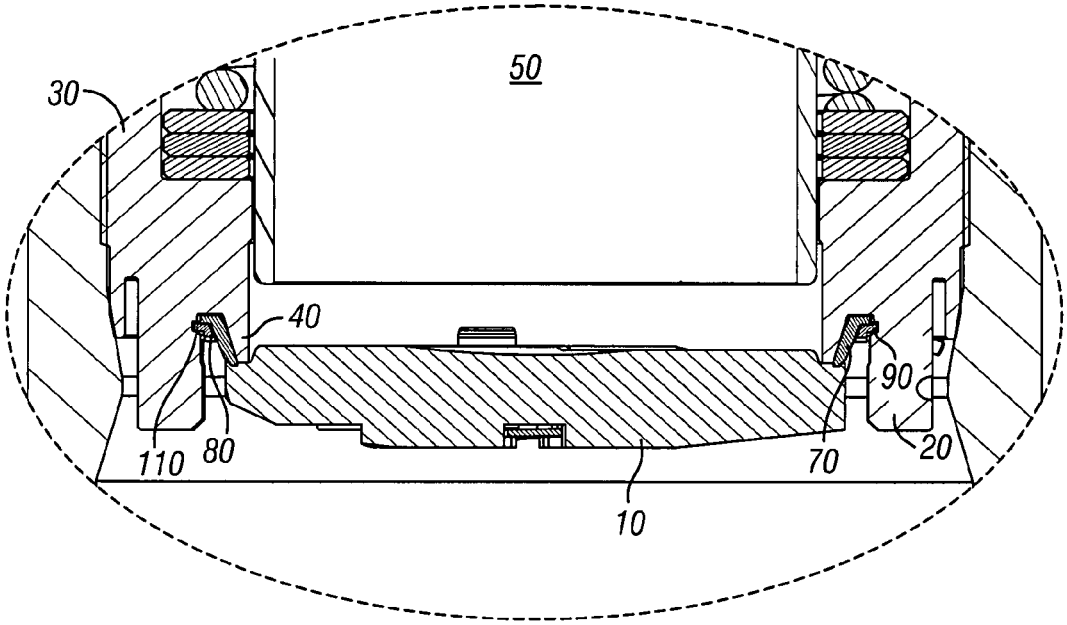
FIG. 3 is another sectional view of an exemplary embodiment of a typical subsurface safety valve with integrated flapper mount, hard seat and soft seat seal with tabbed retaining ring.
Figure 4:
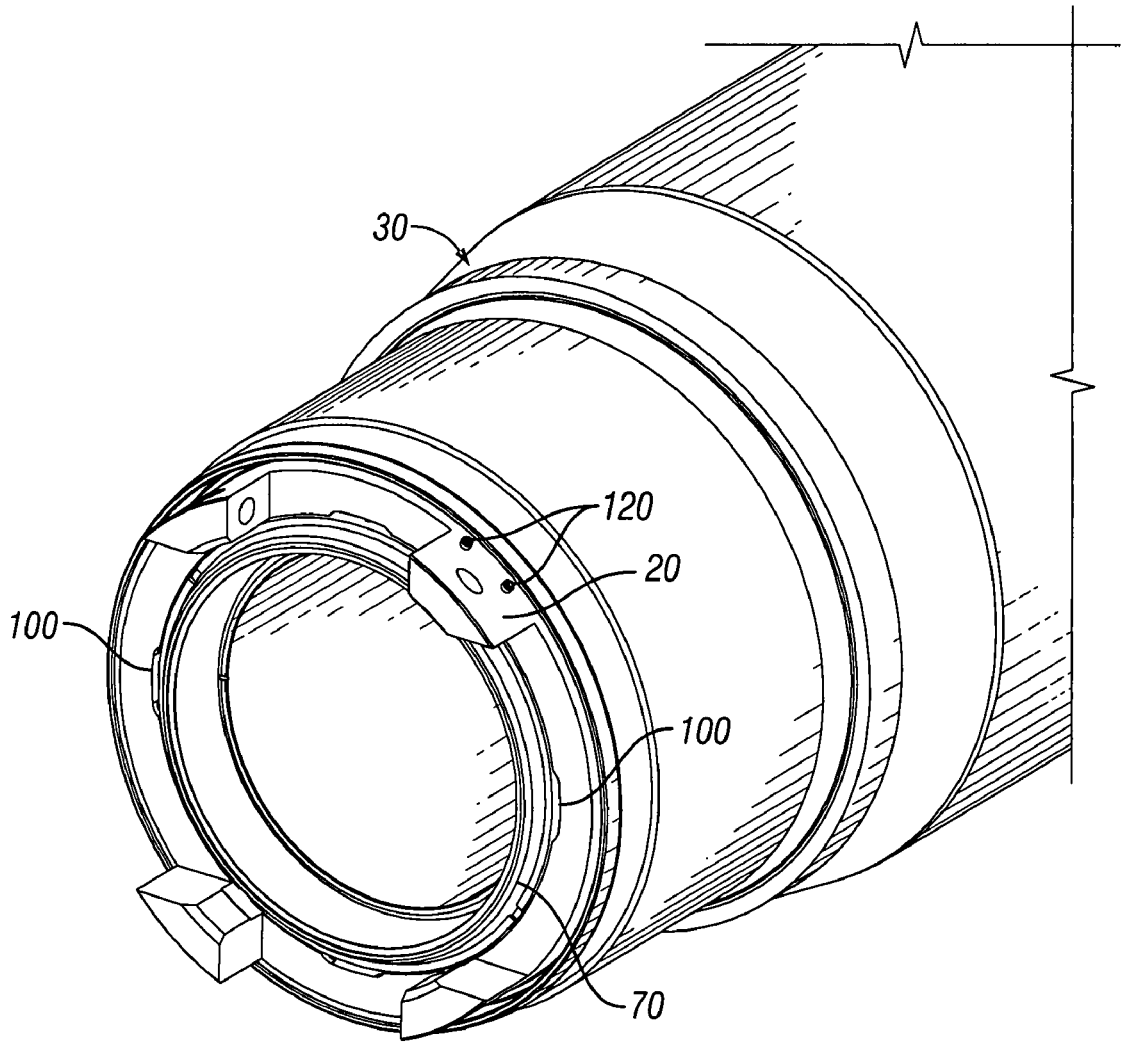
FIG. 4 is an isometric assembled view of an exemplary embodiment of a typical subsurface safety valve with integrated flapper mount, hard seat, and soft seat seal.

Referring in particular to FIG. 2, flapper 10 mounts to hinge posts 20 that protrude from the bottom of the spring housing 30 so that the flapper 10 becomes part of the spring housing 30. A conical surface area (hard seat) 40 annularly surrounding the main bore 50 of the safety valve and protruding from the bottom of the spring housing 30 creates a metal-to-metal contact surface 60 with the flapper 10 when the flapper 10 is in the closed position, as shown in the figure. A non-metal sealing ring 70, or soft seat, installs around the conical surface 40 and is retained in place on the bottom side of the spring housing 30 by a retainer ring 80. Now referring to FIGS. 3 and 5, the outer parts of the retainer ring 80 contain tabs 90 that fit into mating slots 100 milled into the bottom of the housing 30. The tabs 90 insert into the mating slots 100, and, when the retainer ring 80 is rotated, slide into grooves 110 adjacent to the mating slots 100 to prevent the retainer ring 80 from slipping off of the spring housing 30. Two roll pins or set screws 120 insert into two holes 130 on the outer, annular surface of the spring housing 30 and protrude into the groove 110 on each side of at least one tab 90 to immobilize it within the groove 110 to prevent the retainer ring 80 from inadvertently rotating back off of the housing 30. The retainer ring 80 contains slots "castellations" 140 that facilitate rotation by an installation tool (not shown) during assembly.

Referring to FIG. 2, in one embodiment, the soft seat seal 70 fits around the outer side of the conical surface 40 and has a flanged upper end 150 that contacts the bottom side of the spring housing 30 when the seal is pushed up the conical surface 40 by the closing of the flapper 10. The flanged end 150 fits inside a circular, milled slot 160 (FIG. 5) on the bottom side of the spring housing 30. By design, the milled slot 160 (FIG. 5) is larger than the flanged end 150 so that when the soft seat seal 70 installs onto the conical surface 40, the flanged end 150 of the seal 70 does not initially contact the bottom side of the housing 30 or the outer diameter surface of the circular, milled slot 160. When the flapper 10 pivots closed and pressure builds up underneath the flapper 10, the flapper 10 pushes the soft seat seal 70 up the conical surface 40. The gap 170 between the flanged end 150 of the seal 70 and the bottom side of the housing 30 allows the soft seat seal 70 to move upwards without compressing the seal. The soft seat seal 70 material stretches as it slides up the ever-increasing diameter of the conical surface 40, building up energy within the material. When the flapper 10 is opened, the energy stored in the soft seat material releases, causing the soft seat seal 70 to move back up the conical surface 40 to its original position. During opening and closing of the flapper 10, the soft seat seal 70 is not compressed because of its movement along the conical surface 40 and does not get damaged due to compression. Nor is the soft seat seal 70 at risk of a compression set due to repeated openings and closings of the flapper 10.

Figure 5:
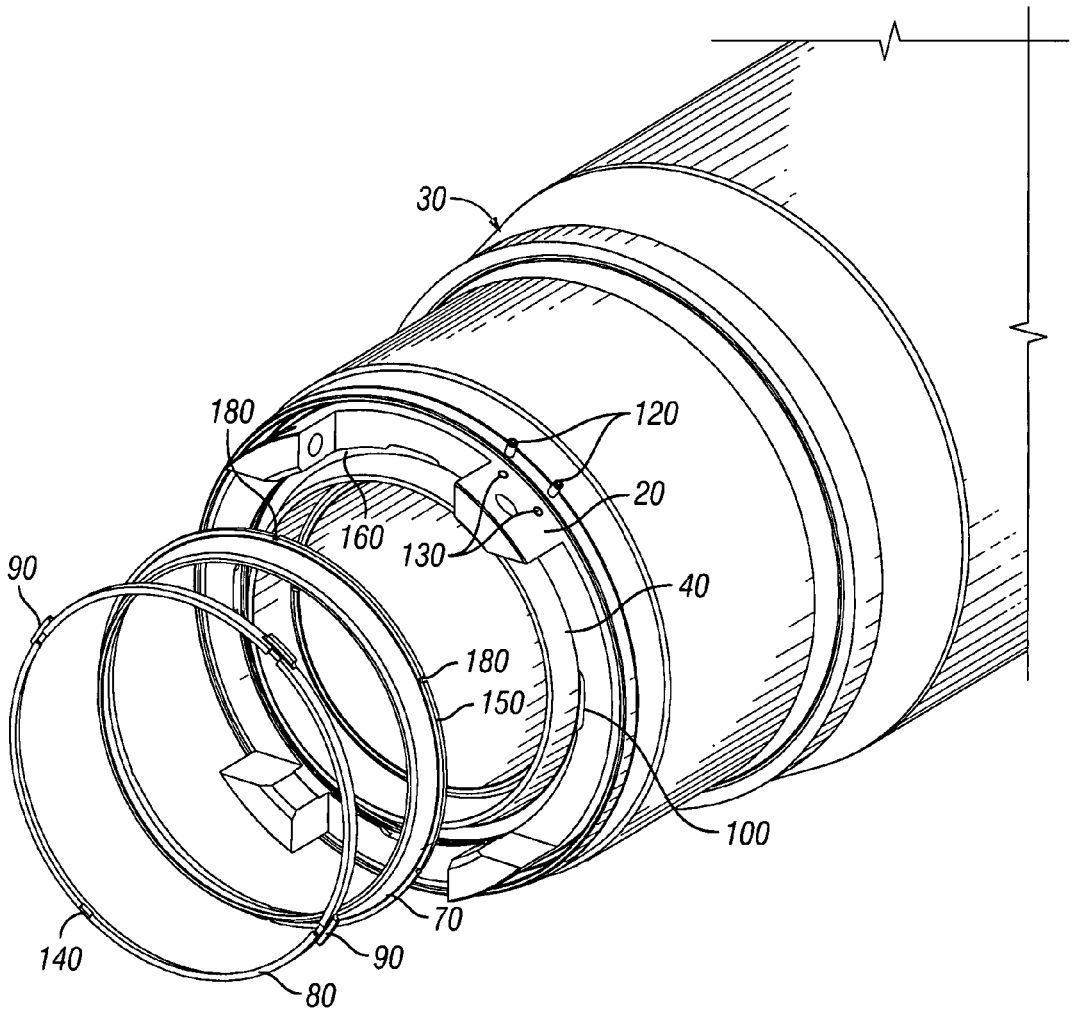
FIG. 5 is an isometric exploded view of an exemplary embodiment of a typical subsurface safety valve with integrated flapper mount, hard seat and soft seat seal with tabbed soft seal retaining ring showing either roll pins or set screws to restrain further movement of the retainer ring upon assembly.

Referring now to FIGS. 2 and 5, the soft seat seal 70 also contains one or more notches 180 along the perimeter of the upper flanged end 150 of the seal 70. When the flapper 10 closes and the soft seat seal 70 is pushed up the conical surface 40, if the gap 170 did not exist between the bottom of the spring housing 30 and the upper flanged end 150 of the soft seat seal 70, the upper flanged end 150 would tend to buckle, thereby opening a gap where gases, such as nitrogen, may get trapped between. When the gas pressures are rapidly bled from below the closed flapper 10 the gases trapped between spring housing 30 and the upper flanged end 150 of the soft seat seal 70 would rush past the seal, deform it, and cause damage to the soft seat material. The gap 170 between the flanged end 150 of the seal 70 and the annular outer surface of the circular milled slot 160, along with the notches 180 along the perimeter of the flanged end 150 of the seal 70, provide a release path for trapped gases, thereby reducing or eliminating the damaging effect of trapped gases behind the seal.

The soft seat material may be made of any suitable elastomeric or non-elastomeric material such as TEFLON®. The retaining ring is made of a metallic material that conforms with the requirements of NACE MR0175.

It will be apparent to one of skill in the art that described herein is a novel method and apparatus for sealing a subsurface valve. While the invention has been described with references to specific preferred and exemplary embodiments, it is not limited to these embodiments. The invention may be modified or varied in many ways and such modifications and variations as would be obvious to one of skill in the art are within the scope and spirit of the invention.

What is claimed is:

1. A subsurface safety valve apparatus, the apparatus comprising:

a spring housing comprising first and second ends, wherein at least a portion of the second end exhibits a generally conical shape;

a non-metallic sealing ring concentrically located around the generally conically-shaped portion of the second end of the spring housing, the non-metallic sealing ring comprising a flanged upper end;

a retainer ring adapted to retain the non-metallic sealing ring around the generally conically-shaped portion of the second end of the spring housing;

at least one hinge post connected to the second end of the spring housing;

a flapper connected to the at least one hinge post, the flapper operable to rotate between an open and closed position; and a gap between the flanged upper end of the non-metallic sealing ring and a bottom side of the second end of the spring housing.

2. The subsurface safety valve apparatus of claim 1, wherein the flanged upper end of the non-metallic sealing ring further comprises at least one notch.

3. The subsurface safety valve apparatus of claim 1, wherein the second end of the spring housing comprises at least one concentric slot capable of receiving the flanged end of the non-metallic sealing ring.

4. The subsurface safety valve apparatus of claim 1, wherein the retainer ring comprises at least one tab.

5. The subsurface safety valve apparatus of claim 4, wherein the second end of the spring housing comprises at least one groove operable to receive the at least one tab of the retainer ring.

6. The subsurface safety valve apparatus of claim 5, wherein the groove is capable of locking the retainer ring in position adjacent to the non-metallic sealing ring.

7. The subsurface safety valve apparatus of claim 6, wherein the retainer ring is further locked in position adjacent to the non-metallic sealing ring by at least one screw extending through the at least one hinge post.

8. The subsurface safety valve apparatus of claim 1, wherein the flapper seals against the generally conically-shaped portion of the second end of the spring housing and the non-metallic sealing ring when in the closed position.

9. The subsurface safety valve apparatus of claim 1, wherein the non-metallic sealing ring moves along the generally conically-shaped portion of the second end of the spring housing without compressing.

10. A subsurface safety valve apparatus, the apparatus comprising:

a spring housing comprising first and second ends, wherein at least a portion of the second end exhibits a generally conical shape;

a non-metallic sealing ring concentrically located around the generally conically-shaped portion of the second end of the spring housing, the non-metallic sealing ring comprising a flanged end having at least one notch;

a retainer ring adapted to retain the non-metallic sealing ring around the generally conically-shaped portion of the second end of the spring housing; and a flapper connected to the second end of the spring housing, the flapper operable to rotate between an open and closed position, the flapper further operable to seal against the generally conically-shaped portion of the second end of the spring housing and the non-metallic sealing ring when the flapper is in the closed position, wherein the non-metallic sealing ring is configured to move up and down the generally conically-shaped portion of the second end of the spring housing.

11. The subsurface safety valve apparatus of claim 10, wherein the second end of the spring housing comprises at least one concentric slot capable of receiving the flanged end of the non-metallic sealing ring.

12. The subsurface safety valve apparatus of claim 10, wherein the retainer ring comprises at least one tab.

13. The subsurface safety valve apparatus of claim 12, wherein the second end of the spring housing comprises at least one groove operable to receive the at least one tab of the retainer ring thereby locking the retainer ring in position adjacent to the non-metallic sealing ring.

14. A method of sealing the central bore of production tubing against fluid flowing from a wellbore towards the surface, the method comprising:

(a) attaching a safety valve assembly to the production tubing, the safety valve assembly comprising:

a spring housing having a lower portion that exhibits a generally conical shape, a non-metallic sealing ring concentrically located around the generally conically-shaped portion of the spring housing, the non-metallic sealing ring comprising an upper flanged end, wherein the lower portion of the spring housing further comprises at least one concentric slot capable of receiving the upper flanged end, a retainer ring adapted to retain the non-metallic sealing ring around the generally conically-shaped portion of the spring housing, and a flapper connected to the lower portion of the spring housing, the flapper operable to rotate between an open and closed position;

(b) providing a gap between the upper flanged end and the at least one concentric slot of the lower end of the spring housing;

(c) placing the safety valve assembly and the production tubing in a wellbore; and (d) closing the flapper such that the flapper seals against the generally conically-shaped portion of the spring housing and the non-metallic sealing ring thereby substantially preventing fluid from flowing from the wellbore towards the surface through the central bore of the production tubing.

15. The method of claim 14, wherein the retainer ring of the safety valve assembly further comprises at least one tab, and the lower end of the spring housing of the safety valve assembly further comprises at least one groove operable to receive the at least one tab of the retainer ring thereby locking the retainer ring in position adjacent to the non-metallic sealing ring.

16. A subsurface safety valve apparatus, the apparatus comprising:

a spring housing comprising first and second ends, wherein at least a portion of the second end exhibits a generally conical shape;

a non-metallic sealing ring concentrically located around the generally conically-shaped portion of the second end of the spring housing;

a flapper connected to the spring housing, the flapper operable to rotate between an open and closed position, and a gap between an upper end of the non-metallic sealing ring and a bottom side of the second end of the spring housing, thereby allowing the non-metallic sealing ring to move along the generally conically-shaped portion of the second end of the spring housing without compressing the non-metallic sealing ring.

17. A subsurface safety valve apparatus as defined in claim 16, wherein the upper end of the non-metallic sealing ring comprises a flange.

18. A subsurface safety valve apparatus as defined in claim 17, wherein the second end of the spring housing comprises a slot configured to receive the flange of the non-metallic sealing ring.

19. A method of using a subsurface safety valve apparatus, the method comprising the steps of:

(a) positioning the subsurface safety valve apparatus in a wellbore, the safety valve apparatus comprising a spring housing having a lower portion, a non-metallic sealing ring concentrically located around the lower portion of the spring housing, and a flapper; and (b) moving the non-metallic sealing ring along the lower portion of the spring housing in response to an opening and closing of the flapper, the movement being accomplished without compressing the non-metallic sealing ring.

20. A method as defined in claim 19, wherein the non-metallic sealing ring moves up the lower portion of the spring housing when the flapper is closed.

21. A method as defined in claim 19, wherein the non-metallic sealing ring moves down the lower portion of the spring housing when the flapper is opened.

* * * * *